US009939160B2

(12) United States Patent
Kim et al.

(10) Patent No.: US 9,939,160 B2
(45) Date of Patent: Apr. 10, 2018

(54) OVEN

(71) Applicant: LG ELECTRONICS INC., Seoul (KR)

(72) Inventors: Wontae Kim, Seoul (KR); Wansoo Kim, Seoul (KR); Sangcheol Lee, Seoul (KR)

(73) Assignee: LG Electronic Inc., Seoul (KR)

( * ) Notice: Subject to any disclaimer, the term of this patent is extended or adjusted under 35 U.S.C. 154(b) by 337 days.

(21) Appl. No.: 14/750,035

(22) Filed: Jun. 25, 2015

(65) Prior Publication Data

US 2015/0377493 A1 Dec. 31, 2015

(30) Foreign Application Priority Data

Jun. 25, 2014 (KR) ..... 10-2014-0078079

(51) Int. Cl.
*F24C 15/16* (2006.01)
*F24C 15/02* (2006.01)

(52) U.S. Cl.
CPC ..... *F24C 15/168* (2013.01); *F24C 15/028* (2013.01); *F24C 15/162* (2013.01)

(58) Field of Classification Search
CPC ..... F24C 15/16; F24C 15/12
USPC ..... 126/339, 333, 337 R; 312/319.1
See application file for complete search history.

(56) References Cited

U.S. PATENT DOCUMENTS 6,113,204 A * 9/2000 Jahrling ..... A47B 88/40 312/319.1
7,087,862 B1 * 8/2006 Shaffer ..... F24C 15/168 126/333
9,239,168 B2 * 1/2016 Brunner ..... A47B 88/40
2006/0102015 A1 * 5/2006 Baker ..... F24C 15/16 99/450
2007/0017387 A1 1/2007 Kim
(Continued)

FOREIGN PATENT DOCUMENTS

CN 201675702 12/2010
CN 201905754 7/2011
(Continued)

OTHER PUBLICATIONS

Chinese Office Action in Chinese Application No. 201510353703.7, dated Apr. 24, 2017, 17 pages (with English translation).
(Continued)

*Primary Examiner* — Gregory Huson
*Assistant Examiner* — Nikhil Mashruwala
(74) *Attorney, Agent, or Firm* — Fish & Richardson P.C.

(57) ABSTRACT

Disclosed is an oven which provides convenient removal of a rack, achieving enhanced usability. The oven includes a cabinet having a chamber, a door to open or close the cabinet, a rack assembly including an operating member to support a cooking object seated thereon, the operating member being removable from the chamber, and a support member fixed inside the chamber to support the operating member, and a spring device including a first fixing piece located at the operating member, a second fixing piece located at the support member, and an elastic member having one side connected to the first fixing piece and the other side connected to the second fixing piece and located in a vertical gap between the operating member and the support member so as to be elastically restored by a distance between the first and second fixing pieces to remove the operating member from the chamber.

30 Claims, 6 Drawing Sheets

(56) References Cited

U.S. PATENT DOCUMENTS

| | | | | |
|---|---|---|---|---|
| 2010/0018517 | A1* | 1/2010 | Chen | F24C 15/166 126/337 R |
| 2012/0006315 | A1* | 1/2012 | Hildner | F24C 15/162 126/337 R |
| 2014/0265796 | A1* | 9/2014 | Rehage | A47B 88/16 312/334.46 |
| 2015/0101590 | A1 | 4/2015 | Armstrong | |
| 2017/0051922 | A1* | 2/2017 | Kaiser | F24C 15/02 |

FOREIGN PATENT DOCUMENTS

| | | | |
|---|---|---|---|
| CN | 102362123 | | 2/2012 |
| DE | 20 2008 009313 | U1 | 11/2009 |
| EP | 1 544 549 | A1 | 6/2005 |
| EP | 1 748 256 | A2 | 1/2007 |
| EP | 1 865 264 | B1 | 5/2009 |
| EP | 2 236 941 | A1 | 10/2010 |
| JP | 2000-193252 | A | 7/2000 |
| JP | 2007-085722 | A | 4/2007 |
| JP | 2009-293846 | A | 12/2009 |
| KR | 10-2010-0091684 | A | 8/2010 |
| KR | 10-2011-0085010 | A | 7/2011 |

OTHER PUBLICATIONS

European Search Report dated Oct. 27, 2015 for European Application No. 15173321.9, 6 pages.

Korean Notice of Allowance dated Oct. 28, 2015 for Korean Application No. 10-2014-0078079, with English Translation, 3 pages.

* cited by examiner

OVEN

CROSS-REFERENCE TO RELATED APPLICATIONS

This application claims the benefit of Korean Patent Application No. 10-2014-0078079, filed on Jun. 25, 2014, which is hereby incorporated by reference as if fully set forth herein.

BACKGROUND OF THE INVENTION

Field of the Invention

The present invention relates to ovens and, more particularly, to ovens that may allow a user to conveniently remove a rack on which an object to be cooked is seated, thereby achieving enhanced usability.

Discussion of the Related Art

Ovens may be referred to as home appliances that cook an object by applying heat thereto. Such an oven generally includes a cabinet defining an external appearance of the oven and a chamber defined in the cabinet to receive an object to be cooked (hereinafter referred to as cooking object).

The interior space of the chamber may be heated to an extremely high temperature. The cooking object within the chamber is cooked using the high temperature. There are a variety of ovens including ovens that use fossil fuel, ovens that use electricity, ovens that use steam, and the like. Of course, these heat sources may be used in combination.

The cabinet may be provided with a rotatable door. The door serves to open or close the chamber. More specifically, the door closes the chamber to isolate the interior space of the chamber from the outside during cooking and then, upon completion of cooking, opens the chamber to communicate the interior space of the chamber with the outside.

In many cases, a rack on which the cooking object is seated may be placed within the chamber. The rack may function to assist the cooking object in being positioned in the interior space of the chamber such that high temperature atmosphere within the chamber is transferred to the cooking object. That is, the rack may function to cause the cooking object to be indirectly cooked via the high temperature atmosphere without direct contact between the cooking object and the heat source.

To cook the cooking object, a user will first open the door and seat the cooking object on the rack placed within the chamber. In this case, the user must extend their hand deep into the chamber. Since the cooking object is generally placed on the rack after the interior of the chamber is preheated to a high temperature, the user has to wear oven mitts when placing the cooking object. Of course, removing the cooking object immediately after completion of cooking or removing the cooking object during cooking to check progress of cooking may inconvenience the user. That is, the user may suffer from great inconvenience when placing or removing the cooking object in or from the high temperature chamber. In particular, a process of placing or removing a heavy cooking object in or from the chamber by hand may be troublesome to the user and cause strain to the user's body. These problems may be further worsened when the rack is fixed in the chamber so as not to be removed outward.

To solve the aforementioned problems, as exemplarily shown in FIGS. 1 and 2, there are provided ovens in which a rack may be removed out of a chamber.

Referring to FIG. 1, the oven, designated by reference numeral 10, includes a cabinet 20, a chamber 25 defined in the cabinet 20 to receive a cooking object, and a door 30 pivotally rotatably connected to the cabinet 20. When a user, designated by reference character "a", grips a handle 40 of the door 30 and opens the door 30, the chamber 25 may communicate with the outside. The door 30 is generally a pull-down type door that is opened as the user grips the handle 40 installed near an upper end of the door 30 and pivotally rotates the door 30 downward.

FIG. 2 shows the interior of the chamber 25 in a completely opened state of the door 20 provided in the oven 10 shown in FIG. 1. Generally, the door 20 may be rotated 90 degrees to be opened.

As exemplarily shown in FIG. 2, a rack 50 is slidably supported by rack supporters 60.

The rack 50 is a component on which a cooking object c is seated. Cooking may be performed after the cooking object c is seated on the rack 50. Of course, the cooking object c may be seated on the rack 50 while being placed on or received in a cooking utensil b.

FIG. 2 shows a configuration in which the rack 50 may be removed from the chamber 25 as the user pulls the rack 25 and the rack 50 may be introduced into the chamber 25 as the user pushes the rack 25. However, in the case of the oven having the above-described configuration, the user has to directly grip and operate the rack 50. In addition, this operation must be continued until the rack 50 is completely removed or introduced by a predetermined distance. Therefore, the rack 50 is inconvenient to use and removal and introduction of the rack 50 may not be smoothly performed due to friction between the rack 50 and the rack supporters 60. Of course, the slidable rack 50 inevitably causes the user's hand to be exposed to a high temperature environment for a long time, in the same manner as in use of a fixed rack.

Referring to FIG. 2, the cabinet 20 is provided with a chamber opening 26 and a gasket 70 mounted around the chamber opening 26. When the door 30 is closed, an inner surface of the door 30 comes into close contact with the gasket 70, thus allowing the interior of the chamber 25 to be sealed.

FIG. 3 shows an oven having an improved configuration as compared to the oven shown in FIG. 2. More particularly, the oven is configured to achieve smoother removal and introduction of the rack 50 via sliding rails 80.

In this configuration, each sliding rail 80 is interposed between a support bracket 60 fixed inside the chamber 25 and a rack bracket 51 fixed to the rack 50. That is, the rack bracket 51 is movable relative to the support bracket 60 via the sliding rail 80.

However, the sliding rack structure basically causes the same problems as the oven shown in FIG. 1, although it provides smoother removal and introduction of the rack 50. For example, the user may still have to grip and operate the high temperature rack until removal or introduction of the rack is completed.

For this reason, there is a need to provide an oven that may provide easy removal and introduction of a rack and allow a user to operate the rack with minimum motion and time. In addition, there is a need to provide an oven that may minimize the frequency and time of the user's hand being exposed to a high temperature environment and to allow a user to operate a rack from the outside of a chamber.

SUMMARY OF THE INVENTION

Accordingly, the present invention is directed to an oven that substantially obviates one or more problems due to limitations and disadvantages of the related art.

In one embodiment, an object of the present invention is to provide an oven which may allow a user to remove or introduce a rack by operating a door rather than the rack. In this way, one embodiment of the present invention is to provide an oven which may allow a user to easily remove or introduce a rack without gripping and operating the high temperature rack.

In one embodiment, an object of the present invention is to provide an oven which may allow a rack to be automatically removed even when a user does not apply force to remove the rack.

In one embodiment, an object of the present invention is to provide an oven which may allow manual removal and automatic removal of a rack to be selectively performed when a door is opened.

In one embodiment, an object of the present invention is to provide an oven which may allow a user to introduce a rack without gripping the rack.

In one embodiment, an object of the present invention is to provide an oven which may allow a user to remove a rack by operating the rack for a short time in an open state of a door.

In one embodiment, an object of the present invention is to provide an oven which includes a spring device to enable automatic removal of a rack, the spring device being installed so as not to come into contact with a cooking object and hidden so as not to be viewed by a user, thus having enhanced reliability.

In one embodiment, an object of the present invention is to provide an oven which may achieve the above-described objects without considerable changes in conventional rack structures.

In one embodiment, an object of the present invention is to provide an oven which may allow automatic removal or semi-automatic removal of a rack to be selectively performed when a door is opened.

In one embodiment, an object of the present invention is to provide an oven which may prevent rapid removal of a rack.

In one embodiment, an object of the present invention is to provide an oven which includes a variety of components to enable automatic removal or semi-automatic removal of a rack, these components being arranged at positions not to be viewed by a user, thereby achieving enhanced reliability and convenience in use. In addition, an object of the present invention is to provide an oven which may prevent these components from being contaminated by a cooking object.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

In accordance with one embodiment of the present invention, an oven includes a cabinet having a chamber configured to receive a cooking object therein, a door configured to open or close the cabinet, a rack assembly including an operating member configured to support the cooking object seated thereon and to be removable outward from the interior of the chamber, and a support member fixed inside the chamber to support the operating member disposed thereon, and a spring device including a first fixing piece located at the operating member, a second fixing piece located at the support member, and an elastic member having one side connected to the first fixing piece and the other side connected to the second fixing piece, the elastic member being located in a vertical gap between the operating member and the support member and being elastically restored by a distance between the first fixing piece and the second fixing piece to remove the operating member from the chamber.

Accordingly, the operating member may be introduced into the chamber via elastic deformation of the spring device and may be removed from the chamber via elastic restoration of the spring device.

In addition, as a result of the spring device being located in the vertical gap between the operating member and the support member, it is possible to prevent increase in the height of the entire rack assembly. In addition, it is possible to prevent interference between the spring device and the cooking object. Of course, the spring device is out of the user's view, which may increase satisfaction of a user.

Removal and introduction of the operating member may be automatically performed as the user opens or closes the door. For example, the operating member may be introduced by the door, i.e. by closing the door. In this case, the spring device, more particularly, the elastic member may be elastically deformed. Then, the operating member may be removed by opening the door. In this case, the spring device, more particularly, the elastic member may be elastically restored. In other words, as the door that keeps the elastic member in an elastically deformed state is moved away from the operating member, the elastic member may be elastically restored. As such, removal of the operating member may be automatically performed as the door is opened.

The oven may further include a coupling device configured to selectively couple the support member and the operating member to each other so as to selectively cause movement of the operating member relative to the support member. The coupling device functions to keep the elastic member in an elastically deformed state. That is, once the support member and the operating member are coupled to each other by the coupling device, the elastic member may be kept elastically deformed even if the door is opened. In this case, removal of the operating member does not occur even if the door is opened.

To remove the operating member, the user may apply force to the operating member in an introduction direction of the operating member for a short time. In this case, coupling between the operating member and the support member by the coupling device may be released due to a gap between the door and the operating member. That is, the coupling by the coupling device is released when the force applied to the operating member is removed, causing elastic restoration of the operating member. Thereby, the operating member may be removed. In this way, the operating member may be semi-automatically removed as the door is opened and coupling by the coupling device is released.

The coupling device may include a latch assembly and a latch striker configured to be selectively coupled to the latch assembly. The latch assembly may be configured to receive at least a portion of the latch striker.

When the latch striker is continuously received in the latch assembly, this may be referred to as a coupling state by the coupling device. Then, when the latch striker is separated from the latch assembly, this may be referred to as a coupling-release state by the coupling device.

Accordingly, a distance between the latch assembly and the latch striker may vary. This distance may correspond to a movement distance of the operating member from an introduced state to a removed state.

The latch assembly may be located at the operating member or the support member, and the latch striker may be located at the support member or the operating member so as to face the latch assembly.

Meanwhile, coupling by the coupling device may be released by force applied to the operating member as well as force applied to the door. For example, when force is applied to the closed door to further move the door in a door closing direction, the moved door may apply pressure to the operating member.

As such, when the user rotates the door to open the door, the operating member may not be removed from the chamber. Conversely, the user may open the door after rotating the door in a door closing direction. Here, when the closed door is rotated in a door closing direction, coupling by the coupling device is released. Thereafter, when the door is opened, the operating member may be automatically removed.

In this way, the user may selectively utilize automatic removal or semi-automatic removal of the operating member. Of course, the user may select whether to remove or introduce the operating member by selecting any one door operating manner.

To operate the operating member via the door, the operating member may come into contact with an inner surface of the door in a closed state of the door. In addition, in such a contact state, the operating member may remain coupled to the support member by the coupling device.

The coupling between the operating member and the support member by the coupling device may be released as the operating member is further moved in a coupling direction of the coupling device.

The spring device may be arranged at one side or both sides of the rack assembly. For example, the spring device may be located at one side or both sides of the rack assembly rather than being located at the center of the rack assembly. This is because the center of the rack assembly is a location where the cooking object is seated and has a risk of contamination of the spring device by the cooking object. In addition, providing the spring device at the center of the rack assembly may cause a complicated configuration of the center of the rack assembly. In this case, transfer of high temperature atmosphere to the cooking object may be difficult. Of course, this is because the spring device may interfere with the cooking object in the course of placing or removing the cooking object on or from the rack assembly.

The coupling device may be arranged at one side or both sides of the rack assembly. Similarly, the coupling device may be located at one side or both sides of the rack assembly rather than being located at the center of the rack assembly.

The spring device may be arranged at one side of the rack assembly, and the coupling device may be arranged at the same side as the spring device. That is, providing the spring device and the coupling device at the same location may enhance reliability.

The elastic member may include a leaf-spring configured to be elastically deformed such that the number of windings thereof around the first fixing piece or the second fixing piece is reduced as a distance between the first fixing piece and the second fixing piece increases. That is, the elastic member is greatly elastically deformed as the number of windings thereof decreases. This means that potential elastic restoration force of the elastic member increases.

One end of the elastic member is fixedly wound around one of the first fixing piece and the second fixing piece, and the other end of the elastic member is secured to the other one of the first fixing piece and the second fixing piece. For example, one end of the elastic member may be fixedly wound around the second fixing piece and the other end of the elastic member may be secured to the first fixing piece. As such, when the first fixing piece is moved away from the second fixing piece, the number of windings of the elastic member decreases as a distance between the first fixing piece and the second fixing piece increases. That is, greater elastic deformation occurs as the distance between the first fixing piece and the second fixing piece increases, which results in greater potential elastic restoration force.

Thereafter, once force to cause elastic deformation disappears, the elastic member is elastically restored such that the number of windings thereof increases. In this case, the first fixing piece is moved toward the second fixing piece.

Accordingly, the operating member may be wholly received in the chamber when the elastic member is elastically deformed, and the operating member may be partially removed from the chamber when the elastic member is elastically restored.

Meanwhile, to introduce the operating member, it is necessary to directly or indirectly apply force to the operating member. However, the operating member may be rapidly removed by elastic restoration of the elastic member. Accordingly, the oven may further include a damper configured to come into contact with the operating member to prevent rapid removal of the operating member.

The damper may generally generate repulsive force in proportion to a movement speed of the operating member rather than a distance between the operating member and the door. Accordingly, the damper may prevent rapid removal of the operating member.

The door may be a pull-down type door to allow a user to grip a door handle and open the door downward. Accordingly, the user may easily view the operating member, which is horizontally arranged within the chamber so as to be introduced into and removed from the chamber, when opening or closing the door.

The oven may further include a shock-absorbing member configured to come into contact with the inner surface of the door when the door is closed in a removed state of the operating member, the shock-absorbing member converting closing force of the door into force to introduce the operating member into the chamber. The shock-absorbing member may be located at a contact region between the door and the operating member. That is, one or all of the door and the operating member may be provided with the shock-absorbing member.

The shock-absorbing member may include a roller configured to be rotated about a rotating shaft parallel to a rotating shaft of the door.

Accordingly, it is possible to prevent the operating member from scratching or sliding on the inner surface of the door upon opening or closing of the door. That is, the operating member may perform rolling on the inner surface of the door. In other words, rolling contact between the door and the operating member rather than sliding contact may be performed, which may achieve various effects, such as reduction of friction, smooth operation, reduction of damage to the door or the operating member, and the like.

Meanwhile, it is necessary to limit a removal distance of the operating member. This is because an excessive removal distance may cause the operating member to be insufficiently supported by the support member. Therefore, a stopper may be provided to achieve an appropriate removal distance. The stopper may be located between the operating member and the support member to selectively come into contact with one of the operating member and the support member. That is, further removal of the operating member does not occur once the operating member comes into contact with the stopper.

The support member may include support member brackets fixed at both sides of the chamber, a support member rail installed to an inner surface of each of the support member brackets, and a support member frame connecting both the support member brackets to each other.

The operating member may include operating member brackets fixed at both sides of the chamber, an operating member rail installed to an outer surface of each of the operating member brackets, the operating member rail being connected to the support member rail, and an operating member frame connecting both the operating member brackets to each other.

Here, the inner surface of the bracket may be a surface facing the center of the chamber and the outer surface of the bracket may be a face facing a sidewall of the chamber.

The support member rail and the operating member rail are located between the support member bracket and the operating member bracket. The operating member bracket may move relative to the support member bracket as the operating member rail slides relative to the support member rail.

The support member bracket and the operating member bracket may be shaped to surround at least a portion of each of the support member rail and the operating member rail. Accordingly, it is possible to prevent the support member rail and the operating member rail from being contaminated by the cooking object.

The operating member frame may be upwardly spaced apart from the support member frame by a prescribed distance. Accordingly, there is no interference between the operating member frame and the support member frame.

The operating member may be removed by sliding relative to the support member as the operating member rail moves relative to the support member rail upon elastic restoration of the elastic member.

In accordance with another embodiment of the present invention, an oven includes a cabinet having a chamber configured to receive a cooking object therein, a door configured to open or close the cabinet, a rack assembly including an operating member configured to support the cooking object seated thereon and to be removable outward from the interior of the chamber, and a support member fixed inside the chamber to support the operating member disposed thereon, and a spring device configured to remove the operating member from the chamber by being elastically restored as the door is opened, and to introduce the operating member into the chamber by being elastically deformed as the door is closed.

The support member may include a support member frame extending from one side to the other side of the chamber, and the operating member may include an operating member frame extending from one side to the other side of the chamber to support the cooking object seated thereon, the operating member frame being upwardly spaced apart from the support member frame by a prescribed distance.

The support member may include support member brackets fixed at both sides of the chamber and a support member rail installed to an inner surface of each of the support member brackets, and the operating member may include operating member brackets fixed at both sides of the chamber and an operating member rail installed to an outer surface of each of the operating member brackets, the operating member rail being connected to the support member rail.

Each of the support member frame and the operating member frame may include a plurality of transversal frames extending in a left-and-right direction and a plurality of longitudinal frames extending in a front-and-rear direction.

The spring device may be located in a vertical gap between the bottom of the operating member bracket and a corresponding one of the transversal frames of the support member frame.

The spring device may include a first fixing piece located at the bottom of the operating member bracket, a second fixing piece located at the corresponding transversal frame of the support member frame, and an elastic member having one side connected to the first fixing piece and the other side connected to the second fixing piece, the elastic member being elastically restored by a distance between the first fixing piece and the second fixing piece to remove the operating member from the chamber.

The elastic member may extend from the first fixing piece to the second fixing piece along a lower surface of the operating member bracket.

The first fixing piece may protrude downward of the operating member bracket by a prescribed distance so as to be caught by the second fixing piece, thereby serving to limit a removal distance of the operating member.

One of the operating member brackets provided with the first fixing piece may have a rearwardly protruding extension differently from the other operating member bracket to achieve a distance between the first fixing piece and the second fixing piece, and the first fixing piece may be located at the extension. The extension may provide a sufficient magnitude of elastic restoration force and may also provide continuous and uniform elastic restoration force within an elastic restoration distance range.

The transversal frames of the support member frame and the operating member frame may be respectively connected to the support member brackets and the operating member brackets. The respective transversal frames may be connected to the longitudinal frames.

The number of the longitudinal frames of the operating member frame may be greater than the number of the longitudinal frames of the support member frame.

Basically, the transversal frames function to connect both the brackets to each other. Thus, the number of the transversal frames may be determined to simply provide structural stability, and may be within a range of two to four.

However, the number of the longitudinal frames of the operating member frame may be greater than the number of the other frames. This is because it is necessary to place various shapes of cooking appliances on the operating member frame. The transversal frames and the longitudinal frames of the operating member frame are connected to each other to construct a mesh structure. Thus, increase in the number of the longitudinal frames may provide a dense mesh structure. However, an excessively dense mesh structure may block passage of hot air directed from the bottom of the chamber. Hence, the number of the longitudinal frames must be appropriately selected.

The longitudinal frames of the operating member frame may have a greater front-and-rear length than a front-and-rear length of the longitudinal frames of the support member frame. In addition, the transversal frame located at a foremost position of the operating member frame may include a forwardly protruding portion. The protruding portion may more protrude forward than the longitudinal frames of the support member frame.

The support member frame and the operating member frame may take the form of a wire mesh.

Meanwhile, the coupling device and/or the damper as described above may be located at the bottom of the operating member and, more particularly, at the bottom of the operating member bracket. As such, similar to the above-described spring device, the the coupling device and/or the damper may be out of the user's view. This is because the user who stands or bends over will generally look down a rack provided in a general oven.

In this way, it is possible to prevent the spring device, the coupling device and the damper from being contaminated by the cooking object. This may prevent damage to these devices and increase reliability and use convenience of the oven.

In accordance with a further embodiment of the present invention, an oven includes a cabinet having a chamber configured to receive a cooking object therein, a door configured to open or close the cabinet, a rack support member including a pair of support member brackets, a support member rail coupled to each of the support member brackets, and a support member frame connecting both the support member brackets to each other, a rack operating member including a pair of operating member brackets, an operating member rail coupled to each of the operating member brackets, the operating member rail being connected to the support member rail, and an operating member frame connecting both the operating member brackets to each other, and a spring device including a first fixing piece located at one of the operating member brackets, a second fixing piece located at the support member frame, and an elastic member having one side connected to the first fixing piece and the other side connected to the second fixing piece, the elastic member being elastically restored by a distance between the first fixing piece and the second fixing piece to remove the operating member from the chamber.

Here, a rack assembly may be said as including the rack operating member and the rack support member.

The operating member bracket is located under the support member frame. That is, a vertical gap may be defined between the operating member bracket and the support member frame. As such, there is no interference between the operating member bracket and the support member frame.

The elastic member may be located in the vertical gap.

The operating member bracket may have a prescribed left-and-right width. In addition, the elastic member may have a width equal to or less than the left-and-right width of the operating member bracket.

The elastic member may be a leaf spring to be elastically deformed by being unwound and to be elastically deformed by being wound. Accordingly, the elastic member may be configured to be unwound in a longitudinal direction of the operating member bracket. That is, since the spring device is located at the bottom of the operating member and the cooking object is disposed on the operating member, there is no interference between the spring device and the cooking object.

The above-described respective embodiments may be combined in various ways so long as features of these embodiments are not contradictory or exclusive to one another.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Hereinafter, an oven according to one embodiment of the present invention will be described in detail with reference to the accompanying drawings.

Figure 4:
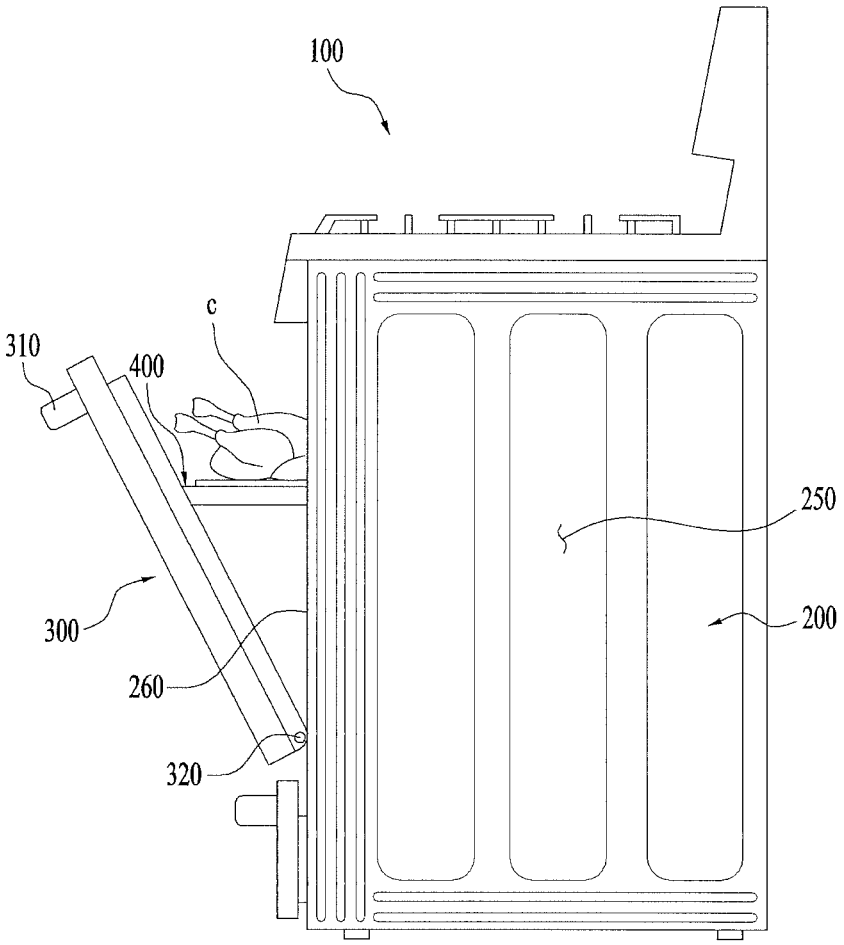
FIG. 4 is a schematic view showing a use state of an oven according to one embodiment of the present invention.

First, one embodiment of the present invention will be described in brief with reference to FIG. 4. FIG. 4 is a schematic view for brief description of the technical idea related to one embodiment of the present invention.

Figure 1:
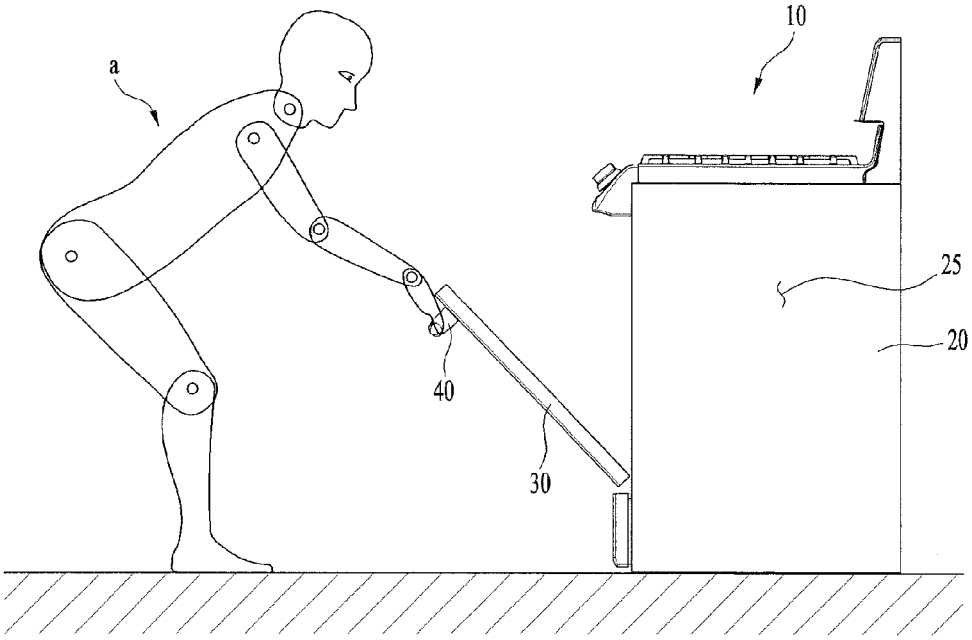
FIG. 1 is a schematic view showing a state in which a user opens a door of a general oven.
Figure 2:
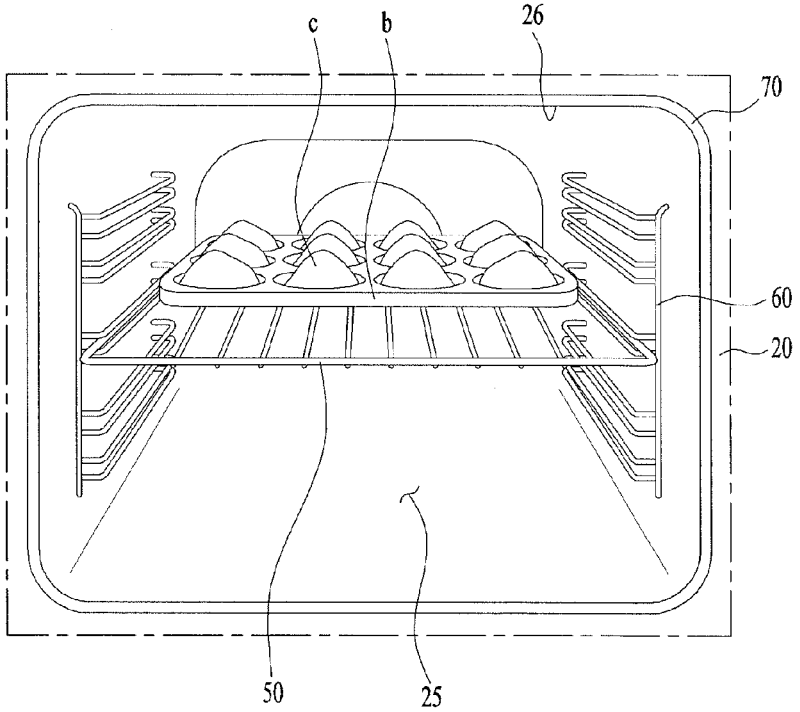
FIG. 2 is a schematic view showing a chamber of a conventional oven.
Figure 3:
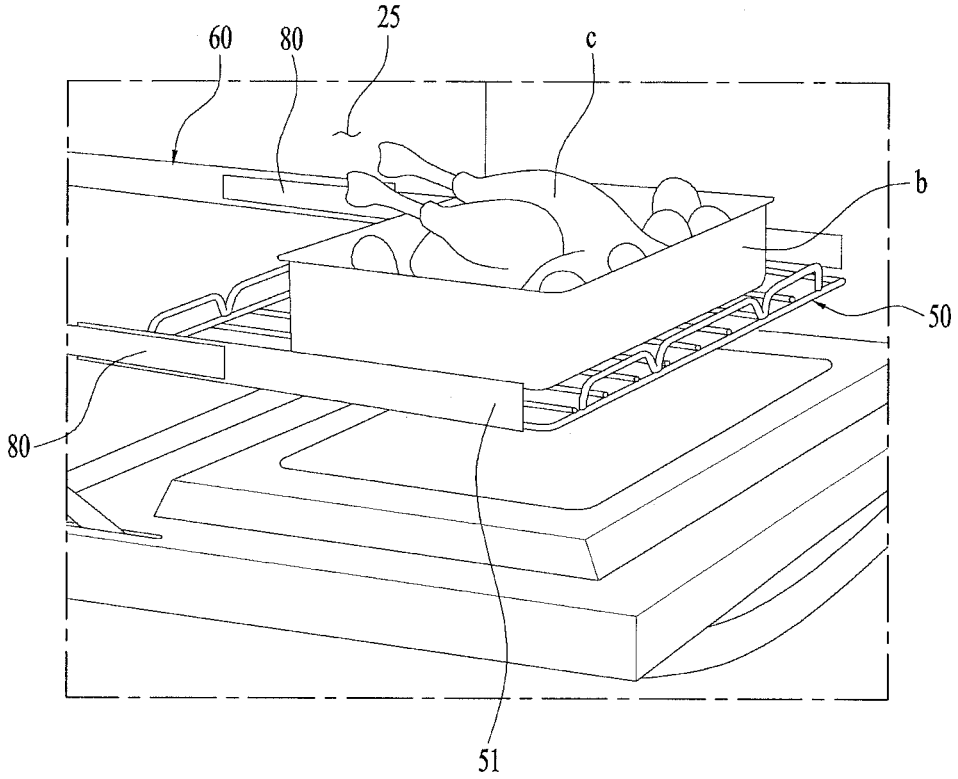
FIG. 3 is a schematic view showing a rack removed from another conventional oven.

The oven, designated by reference numeral 100, according to the present embodiment may include a cabinet 200, a chamber 250, a door 300 and a rack 400, in the same manner as the conventional ovens shown in FIGS. 1 to 3. However, note that the present embodiment may eliminate removal or introduction of the rack 400 caused when a user continuously applies force to the rack 400. For example, the present embodiment may allow the rack 400 to be removed as the user grips a door handle 310 and opens the door 300. In addition, the present embodiment may allow the rack 400 to be introduced as the user grips the door handle 310 and closes the door 300.

Accordingly, the present embodiment may minimize the time and frequency of the user gripping the rack 400 heated to a high temperature and, similarly, may minimize the time and frequency of the user putting their hand into the chamber 250 heated to a high temperature.

More specifically, the door 300 is opened as the user grips the door handle 310 and pivotally rotates the door 300 downward. In this case, the door 300 is rotated about a door rotating shaft 320 that is installed to a lower end of the door 300 corresponding to a lower portion of the cabinet 200. For example, as exemplarily shown in FIG. 4, the door 300 may be opened by being rotated counterclockwise about the door rotating shaft 320.

As the door 300 is opened, a distance between the door 300 and a chamber opening 260 gradually increases. This may be understood as the door 300 blocked the chamber opening 260 being removed and thus an obstacle in front of the rack 400 being removed. Of course, this may also be understood as a position of the obstacle gradually becoming distant from the chamber opening 260.

Through removal or farther movement of the door 300, i.e. the obstacle, the rack 400 may protrude out of the chamber opening 260. That is, the rack 400 may be removed. Force required to remove the rack 400 may be elastic restoration force as will be described below.

Conversely, when the door 300 is closed, the door 300 interferes with the removed rack 400. In this case, the closed door 300 comes into contact with the rack 400, thereby introducing the rack 400.

In this way, opening and closing of the door 300 may create a space for removal of the rack 400 and provide force required to introduce the rack 400.

Hereinafter, one embodiment of the present invention will be described in more detail with reference to FIGS. 5 to 7.

As described above, the oven according to one embodiment of the present invention has a feature related to the rack that may be easily removed and introduced. Thus, a configuration of the rack will be described below in more detail.

In the present embodiment, the rack 400, as will be described below, may include not only a component to support a cooking object c seated thereon, but also a component to support the rack 400 within the chamber 250. Accordingly, the rack as described above may be referred to as a rack assembly 400. The rack assembly 400 separated from the interior of the chamber 250 will be described below in detail.

The accompanying drawings show the rack assembly 400 separated from the cabinet 200 or the chamber 250.

The rack assembly 400 may include an operating member 500 on which the cooking object is seated, the operating member 500 being configured to be removable from the chamber 250, and a support member 600 fixed inside the chamber 250 to support the operating member 500 disposed thereon.

Figure 5:
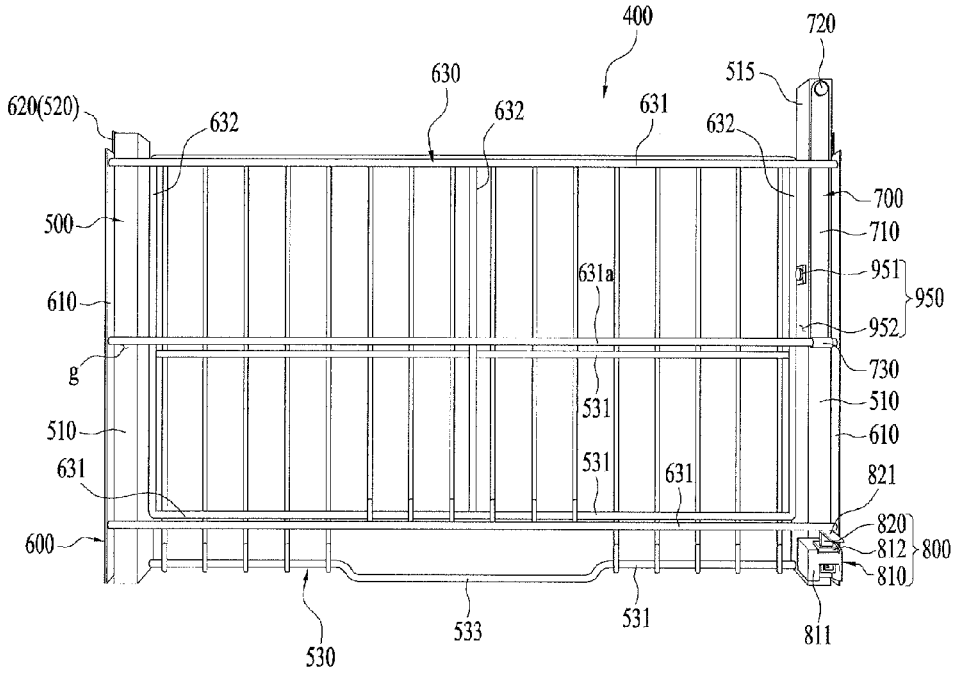
FIG. 5 is a bottom perspective view showing a retracted state of an operating member included in a rack assembly according to one embodiment of the present invention.
Figure 6:
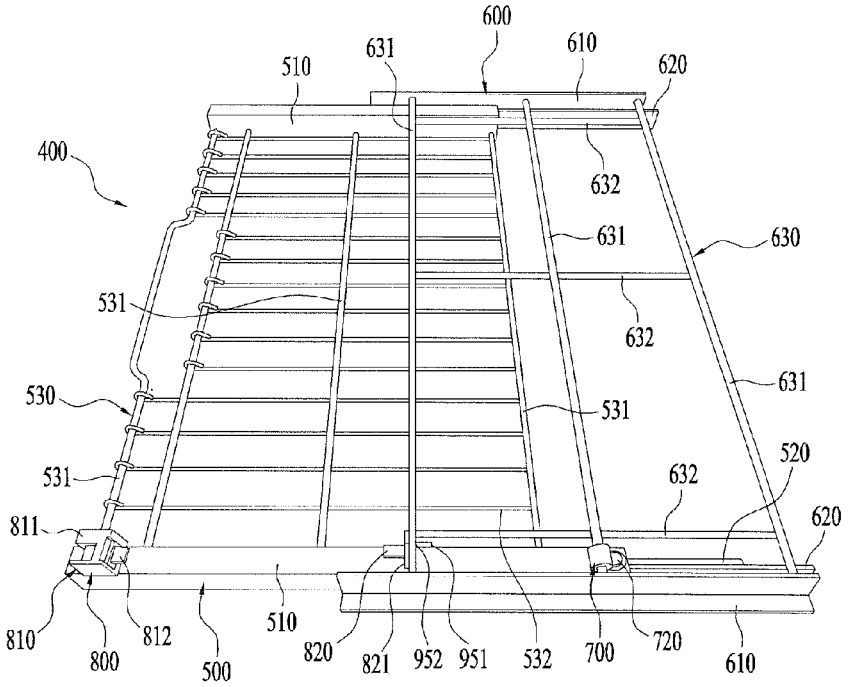
FIG. 6 is a bottom perspective view showing a pulled state of the operating member in the rack assembly shown in FIG. 5.
Figure 7:
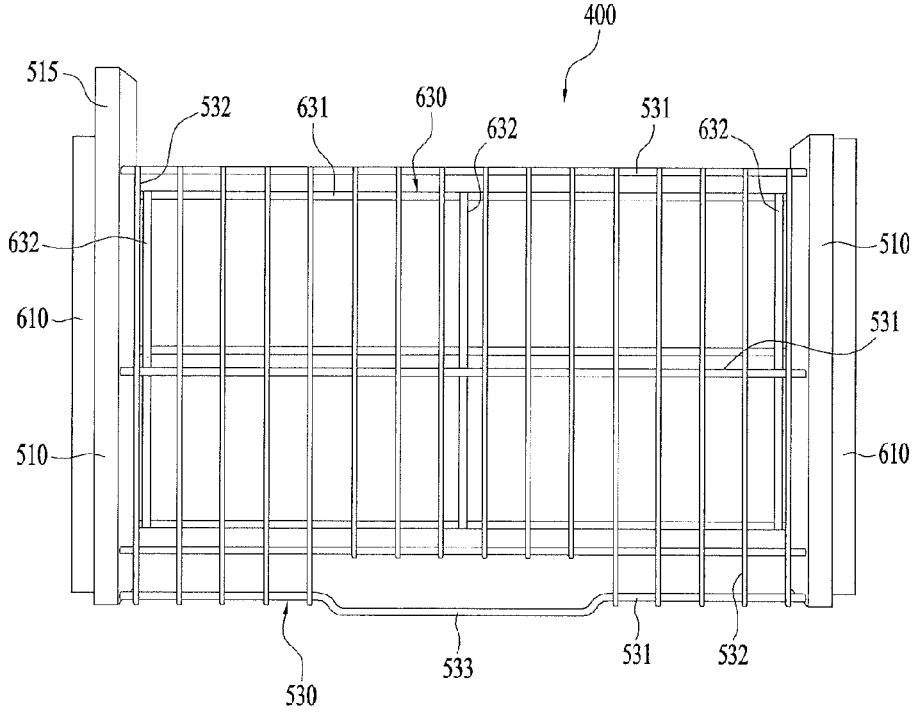
FIG. 7 is a top perspective view showing a retracted state of the operating member in the rack assembly shown in FIG. 5.

FIG. 5 shows a reversed state of the rack assembly 400 in a state in which the operating member 500 of the rack assembly 400 is introduced into the chamber 250, and FIG. 6 shows a reversed state of the rack assembly 400 in a state in which the operating member 500 of the rack assembly 400 is removed from the chamber 250.

The support member 600 is fixed inside the chamber 250. Thus, the operating member 500 may be moved relative to the support member 600 for introduction and removal thereof.

The support member 600 may include support member brackets 610 fixed respectively at both sides inside the chamber 250. Basically, the operating member 500 may be supported by the support member brackets 610.

The operating member 500 may include operating member brackets 510 corresponding to the support member brackets 610. As such, the support member brackets 610 may slidably support the operating member brackets 510.

More specifically, rails 520 and 620 may be provided to enable smooth sliding of the brackets 510 relative to the brackets 610. The rails 520 and 620 may be interposed between the support member brackets 610 and the operating member brackets 510 to enable linear movement of the operating member brackets 510 relative to the support member brackets 610.

In particular, the rails 520 and 620 may include a support member rail 620 attached to an inner surface of each support member bracket 610 and an operating member rail 520 attached to an outer surface of each operating member bracket 510. Here, the inner surface may be a surface facing the center of the chamber and the outer surface may be a surface facing a sidewall of the chamber.

The support member rail 620 and the operating member rail 520 are connected to each other to enable relative sliding therebetween. However, there may be various other alterations with regard to a rail structure that enables linear movement of the operating member 500. That is, a structure that allows the operating member bracket 510 to linearly move relative to the support member bracket 610 may be altered in various ways.

The support member 600 may include a support member frame 630 to connect both the support member brackets 610 to each other. Thus, the support member frame 630 may basically extend from one side to the other side of the chamber.

More specifically, the support member frame 630 may include transversal frames 631 extending in a left-and-right direction and longitudinal frames 632 extending in a front-and-rear direction. These frames 631 and 632 may be plural in number.

Here, the support member frame 630 may serve to increase rigidity of the support member 600. Thus, the support member frame 630 may vary in terms of the number and position thereof. Of course, the support member frame 630 may be omitted as needed. For example, in FIG. 3, the support member frame 630 is omitted. However, as will be described below, the support member frame 630 may be required for installation of a spring device 700. In particular, the transversal frame 631 may be provided for installation of the spring device 700.

Similarly, the operating member 500 may include an operating member frame 530 to connect both the operating member brackets 510 to each other. Thus, the operating member frame 530 may basically extend from one side to the other side of the chamber (in a left-and-right direction).

More specifically, the operating member frame 530 may include transversal frames 531 extending in a left-and-right direction and longitudinal frames 532 extending in a front-and-rear direction. These frames 531 and 532 may be plural in number. Thus, the operating member frame 530 may serve to increase rigidity of the operating member 500.

Here, the number of the longitudinal frames 532 is preferably greater than the number of the other frames 532, 631 or 632. This is because the transversal frames 531 and the longitudinal frames 532 are connected to each other to construct a mesh structure. That is, the resulting mesh structure serves to support the cooking object seated thereon and to allow passage of hot air directed from the bottom of the chamber.

In addition, one of the transversal frames 531, which is located at a foremost position of the operating member frame 530, may include a forwardly protruding portion 533. The protruding portion 533 may be located at the center of the operating member 500 in a left-and-right direction. Thus, the protruding portion 533 may function as not only a rack handle, but also a contact piece to come into contact with the door.

The operating member 500 is preferably located above the support member 600. In particular, both the operating member frame 530 and the operating member brackets 510 are preferably located above the support member frame 630.

More specifically, the operating member frame 530 and the support member frame 630 define a vertical gap therebetween to prevent interference therebetween. In particular, the support member frame 630 and a lower end of the operating member 500 preferably define a prescribed gap therebetween. In addition, in a reversed state of the rack assembly 400, the support member frame 630 is preferably connected to the operating member frame 530 at a height that is equal to or higher than a lower end of the operating member frame 530.

With this configuration, the entire operating member 500 is located above the support member frame 630 with a gap therebetween, which may prevent interference therebetween. In particular, a vertical gap g between the support member frame 630 and the operating member brackets 510 may be required to enable installation and functioning of the spring device 700 that will be described below.

In the present embodiment, the spring device 700 may be provided along with the above-described rack assembly 400. The spring device 700 serves to enable removal and introduction of the operating member 500 via elastic deformation and elastic restoration thereof.

The spring device 700 may include an elastic member 710 that is elastically deformed when the operating member 500 is introduced and elastically restored to remove the operating member 500. For example, the elastic member 710 may be elastically restored to enable removal of the operating member 500 when force to cause or maintain elastic deformation of the elastic member 710 is removed. In addition, the elastic member 710 causes the operating member 500 to be removed from the chamber via elastic restoration thereof as the door is opened, and then causes the operating member 500 to be introduced into the chamber via elastic deformation thereof as the door is closed.

Here, the door 300 may serve to keep the elastic member 710 in an elastically deformed state. That is, in a closed state of the door 300, force required to open the door 300 may be greater than elastic restoration force of the elastic member 710. Thus, the elastic member 710 may be kept elastically deformed by the door 300. In addition, to keep the elastic member 710 in an elastically deformed state, there may be a coupling device 800. The coupling device 800 will be described below in detail.

Elastic deformation and elastic restoration of the spring device 700 occurs as the distance between the operating member 500 and the support member 600 varies. More specifically, elastic deformation and elastic restoration of the elastic member 710 may occur as a distance between the operating member 500 and the support member 600 varies via removal and introduction of the operating member 500. Accordingly, reference points with regard to the distance between the operating member 500 and the support member 600 may be necessary. The elastic member 710 is preferably elastically deformed when a distance between the reference points increases, and elastically restored when the distance between the reference points decreases.

More specifically, the reference points may correspond to a first fixing piece 720 located at the operating member 500 and a second fixing piece 730 located at the support member 600. The elastic member 710 may be located between the first fixing piece 720 and the second fixing piece 730 to perform elastic deformation and elastic restoration. That is, when a distance between the first fixing piece 720 and the second fixing piece 730 becomes the minimum (in a maximally removed state of the operating member 500), this state may correspond to completion of elastic restoration of the elastic member 710. When a distance between the first fixing piece 720 and the second fixing piece 730 becomes the maximum (in a maximally introduced state of the operating member 500), this state may correspond to maximum elastic deformation of the elastic member 710.

The elastic member 710 may be a leaf spring. That is, one end of the elastic member 710 may be fixed to the first fixing piece 720 or the second fixing piece 730 and the other end of the elastic member 710 may be wound around the second fixing piece 730 or the first fixing piece 720. As such, increase in the number of windings of the elastic member 710 refers to elastic restoration, and reduction in the number of windings refers to elastic deformation.

FIG. 5 shows that the first fixing piece 720 is located at a distal end of the operating member bracket 510 and the second fixing piece 730 is located at the support member frame 630, more particularly, at one of the transversal frames 631 of the support member frame 630. In particular, the elastic member 710 is wound around the second fixing piece 730. In FIG. 5, a state in which the operating member 500 is maximally introduced is shown and this may be a maximally elastically deformed state of the elastic member 710. Conversely, in FIG. 6, a state in which the operating member 500 is maximally removed is shown and this may be a maximally elastically restored state of the elastic member 710. Accordingly, it will be appreciated from FIG. 6 that the operating member 500 may reach a maximally removed state thereof when the first fixing piece 710 and the second fixing piece 720 substantially come into contact with each other.

More specifically, the elastic member 710 may be located at a lower surface of the operating member bracket 510. That is, the elastic member 710 may be unwound or wound along the lower surface of the operating member bracket 510. In addition, a width of the elastic member 710 is preferably not greater than a width of the operating member bracket 510. In addition, the first fixing piece 720 is preferably located at a distal end of the lower surface of the operating member bracket 510 and the second fixing piece 730 is preferably located at one side of the transversal frame 631 of the support member 600. Of course, the first fixing piece 720 and the second fixing piece 730 are preferably arranged in line.

The first fixing piece 720 may protrude downward from the lower surface of the operating member bracket 510. That is, the first fixing piece 720 may be caught by the second fixing piece 730 in a maximally removed state of the operating member 510. This may prevent the first fixing piece 720 from passing over the second fixing piece 730 by elastic restoration force of the elastic member 710. Through such interference therebetween, the first fixing piece 720 and the second fixing piece 730 may function as stoppers to limit a removal distance of the operating member 500.

Meanwhile, the transversal frame 631 of the support member 600, provided with the second fixing piece 730, may be the transversal frame 631 located at the center of the support member 600 in a front-and-rear direction. More particularly, the corresponding transversal frame 631 may be referred to as a fixing piece transversal frame 631*a*. As a distance between the fixing piece transversal frame 631*a* and a front end of the support member 600 decreases, a greater removal distance of the operating member 500 may be accomplished. However, when the removal distance excessively increases, a length of the operating member 500 supported by the support member 600 may excessively decrease. This may cause the operating member 500 to be tilted downward when removed in a state in which the cooking object is seated thereon.

On the other hand, a removal distance of the operating member 500 may be reduced as a distance between the fixing piece transversal frame 631*a* and a rear end of the support member 600 decreases. In this case, it may be impossible to achieve a sufficient removal distance of the operating member 500.

The fixing piece transversal frame 631*a* may serve to increase rigidity of the support member 600. Thus, the fixing piece transversal frame 631*a* is preferably located substantially at the center of the support member 600 in a front-and-rear direction thereof. In this case, a variable distance between the first fixing piece 720 and the second fixing piece 730 may decrease. This means that provision of a sufficient distance for elastic deformation is difficult.

The leaf spring as described above may continuously and relatively uniformly provide greater elastic restoration force as a length thereof increases. Thus, the operating member bracket 510 may include an extension 515 at a rear end thereof such that the first fixing piece 720 is formed at the extension 515. That is, only one of the operating member brackets 510, which is provided with the first fixing piece 720, may include the rearwardly protruding extension 515. Of course, both the operating member brackets 510 may include the extensions 515. However, providing both the operating member brackets 510 with the extensions 515 may not be preferable in consideration of material costs.

Accordingly, through provision of the extension 515, it is possible to achieve a sufficient distance between the first fixing piece 720 and the second fixing piece 730 and, consequently, to provide continuous and uniform elastic restoration force.

It will be appreciated that the spring device 700 may be provided at each of the operating member brackets 510 rather than being provided at any one operating member bracket 510.

The spring device 700 is located substantially under the operating member bracket 510. More specifically, a width of the spring device 700 may be within a width of the operating member bracket 500. Accordingly, the elastic device 700 may be viewed from the bottom of the rack assembly 400 (see FIG. 5), but may not be viewed from the top of the rack assembly 400 (see FIG. 7). In this way, the spring device 700 including the elastic member 710 that is elastically deformable and elastically restorable is out of the user's view. This has the effect of preventing contaminants generated by the cooking object seated on the operating member 500 from entering the spring device 700. In addition, this has the effect of preventing interference between the cooking object and the spring device 700 upon removal and introduction of the cooking object.

In addition, the spring device 700 may be substantially located within a vertical gap g that enables sliding of the operating member 500 relative to the support member 600. More specifically, since the elastic member 710 of the spring device 700 is a leaf spring, the elastic member 710 may be much thinner than the vertical gap g. In addition, the elastic member 710 may not be considerably densely wound on the nature thereof even if a height of the entire elastic member 710 increases as the number of windings increases. In addition, the maximum height of the elastic member 710 and the maximum deformation distance of the elastic member 710 may be taken into consideration. In this way, the vertical gap g may be considerably narrow. In particular, the vertical gap g between the lower surface of the operating member bracket 510 and the top of the support member frame 630 may be considerably narrow. Consequently, the resulting rack assembly 400 may exhibit enhanced stability and reliability because positioning the operating member 500 at a height that is not significantly higher than the support member 600 is allowable.

Meanwhile, note that the spring device 700 may be located between the support member 600 and the operating member 500. As such, it may be said that the rack assembly 400 includes the spring device 700.

According to the embodiment as described above, through provision of the spring device 700, the operating member 500 of the rack assembly 400 may be automatically removed upon opening of the door 300, and may be introduced by the door 300 upon closing of the door 300. In this case, force required to keep the door 30 closed should be greater than elastic restoration force to cause the operating member 500 to be removed. That is, the minimum moment to begin opening of the door 300 (at the door rotating shaft 320) should be greater than moment caused by push force (elastic restoration force) applied to the door 300 by the operating member 500.

Meanwhile, in one embodiment of the present invention, the coupling device 800 may be provided to selectively couple the support member 600 and the operating member 500 to each other. The coupling device 800 may serve to selectively perform movement of the operating member 500 relative to the support member 600. In addition, the coupling device 800 may be located between the support member 600 and the operating member 500. Thus, it may be said that the rack assembly 400 includes the coupling device 800.

FIG. 5 shows a state in which the operating member 500 and the support member 600 are coupled by the coupling device 800, i.e. a state in which movement of the operating member 500 relative to the support member 600 is restricted. That is, this state may be referred to as a maximally introduced state of the operating member 500 and, in other words, a maximally elastically deformed state of the elastic member 710. Of course, as will be described below, in the shown state, a distance between the operating member 500 and the support member 600 for somewhat further introduction of the operating member 500 may be permitted. In turn, further elastic deformation of the elastic member 710 corresponding to the permitted distance may occur, which may allow the operating member 510 to be further introduced. Accordingly, the state shown in FIG. 5 may be referred to as a state in which the operating member 500 and the support member 600 are kept coupled to each other by the coupling device 800.

FIG. 6 shows a state in which the coupling device 800 releases coupling between the operating member 500 and the support member 600, thus causing the operating member 500 to be maximally removed. That is, when the coupling device 800 releases coupling between the operating member 500 and the support member 600 and the door 300 is opened, there no longer exists any obstacle to endure elastic restoration force of the elastic member 700. Thus, the operating member 500 may be maximally removed by elastic restoration force of the elastic member 710.

The coupling device 800 may include a latch assembly 810 and a latch striker 820. The latch assembly 810 may include a latch 812 to catch the latch striker 820 and a latch housing 811 to receive the latch 812 therein.

The latch housing 811 is secured to any one of the operating member 500 or the support member 600, whereas the latch striker 820 is secured to the other one of the operating member 500 or the support member 600. The latch striker 820 may be secured to the support member 600 or the operating member 500 via a latch bracket 821.

With this configuration, the latch 812 and the latch striker 820 may be coupled to each other when introduction of the operating member 500 is completed, and a distance between the latch 812 and the latch striker 820 may become the maximum when removal of the operating member 500 is completed. The distance may be substantially equal to the above-described distance between the first fixing piece 720 and the second fixing piece 730.

As exemplarily shown in FIGS. 5 and 6, the latch assembly 810 has a greater volume than a volume of the latch striker 820. Thus, the latch assembly 810 requires a greater fixing area than the latch striker 820. To this end, the latch assembly 810 is preferably secured to the operating member bracket 510 of the operating member 500 and the latch striker 820 is preferably secured to the support member 600. In addition, the entire coupling device 800 is preferably located under the operating member bracket 510. In particular, the latch assembly 810 is preferably located at a front end of the lower surface of the operating member bracket 510. The latch striker 820 corresponding to the latch assembly 810 may be secured to one of the transversal frames 631 of the support member 600 and, more particularly, to the transversal frame 631 located at a foremost position of the support member 600. In this way, the latch assembly 810 may access and be coupled to the fixed latch striker 820, and may be released and moved away from the fixed latch striker 820.

Of course, the latch assembly 810 and the latch striker 820 are preferably aligned in line in a removal and introduction direction of the operating member 500.

Meanwhile, similar to the spring device 700 as described above, the coupling device 800 may be referred to as a device that performs mechanical actions. Thus, it is preferable to prevent the coupling device 800 from being contaminated by the cooking object. For this reason, similar to the spring device 700, the coupling device 800 is preferably located under the operating member bracket 510. That is, as exemplarily shown in FIG. 7, the coupling device 800 is preferably hidden by the operating member bracket 510.

Similarly, the coupling device 800 may be provided at one side or both sides of the rack assembly 400. In addition, the coupling device 800 may be provided only at one side of the rack assembly 400, along with the above-described spring device 700. In this case, the coupling device 800 and the spring device 700 are preferably provided at the same side.

Configurations and operation principles of the latch assembly 810 and the latch striker 820 will be easily understood. That is, it will be generally understood that any one component is coupled to the other component by moving to the other component and then released from the other component by further moving in a coupling direction. Accordingly, a detailed description related to the latch assembly 810 and the latch striker 820 as one example of the coupling device 800 will be omitted below.

However, note that automatic removal or semi-automatic removal of the operating member 500 may be accomplished using the characteristics of the coupling device 800. That is, the user may select one of these removal types.

More specifically, in the state shown in FIG. 6, the user may introduce the operating member 500 using the door 300, i.e. by closing the door 300. Of course, the user may introduce the operating member 500 by directly applying force to the operating member 500 without operating the door 300 in an opened state of the door 300.

The state shown in FIG. 5 may correspond to a closed state of the door 300. That is, it may be said that the operating member 500 and the support member 600 are kept coupled to each other by the coupling device 800 in a closed state of the door 300. In this case, removal of the operating member 500 does not occur upon opening of the door 300. That is, this coupling by the coupling device 800 is released when the user opens the door 300 and slightly pushes the operating member 500 to further introduce the operating member 500. As such, the operating member 500 may be removed by elastic restoration force of the elastic member 710. This removal of the operating member 500 may be referred to as semi-automatic removal.

Meanwhile, as described above with reference to FIG. 2, the gasket 70 is generally interposed between the door 300 and the cabinet 200 and, more particularly, between an inner surface of the door 300 and the chamber opening 260 of the cabinet 200. The gasket 70 is generally formed of an elastic material. That is, the gasket 70 may provide a distance for elastic deformation.

That is, when push force is applied to further close the door 300 in a state in which the door 300 is completely closed, an inner surface of the door 300 may be moved by a short distance into the chamber 250 via elastic deformation of the gasket 70. When applying this principle to the state shown in FIG. 5, the closed door 300 is moved to be further closed, thereby pushing the operating member 500 to further introduce the operating member 500. In this way, the user may open the door 300 after applying force to further close the door 300 by a short distance for a short time. In this case, as coupling between the operating member 500 and the support member 600 by the coupling device 800 is released and, consequently, the operating member 500 may be automatically removed as the door 300 is opened. That is, removal of the operating member 500 may be accomplished even if the user does not touch the operating member 500. This may be referred to as automatic removal.

Accordingly, when the user opens the door 300, whether or not to remove the operating member 500 may be determined according to whether the user attempts to simply open the door 300 or to first push the door 300 and then open the door 300. The former motion may result in semi-automatic removal and the latter motion may result in automatic removal.

Hence, the range of choice of the user expands and troubles or risk caused by touching the hot operating member 500 even for a short time may be minimized.

Meanwhile, in the case of the semi-automatic removal as described above, the user has to operate the operating member 500 when attempting to introduce the operating member 500. In addition, the user has to push the operating member 500 in an opened state of the door 300 when attempting to remove the operating member 500. With this use manner, contact between the inner surface of the door 300 and the operating member 500 is not under consideration. Of course, when the user opens the door 300 and then closes the door 300 in a state in which the operating member 500 is removed, contact between the door 300 and the operating member 500 may occur. However, any damage due to such contact may be minimized by providing a shock-absorbing member 900 at a contact region.

However, that introduction of the operating member 500 is realized as the user closes the door 300 without operating the operating member 500 may be considerably convenient. That is, it is desirable to achieve smooth contact between the door 300 and the operating member 500 and easy conversion from door closing force to door push force. In addition, the shock-absorbing member 900 preferably serves to prevent damage due to contact and to facilitate conversion of force.

Figure 8:
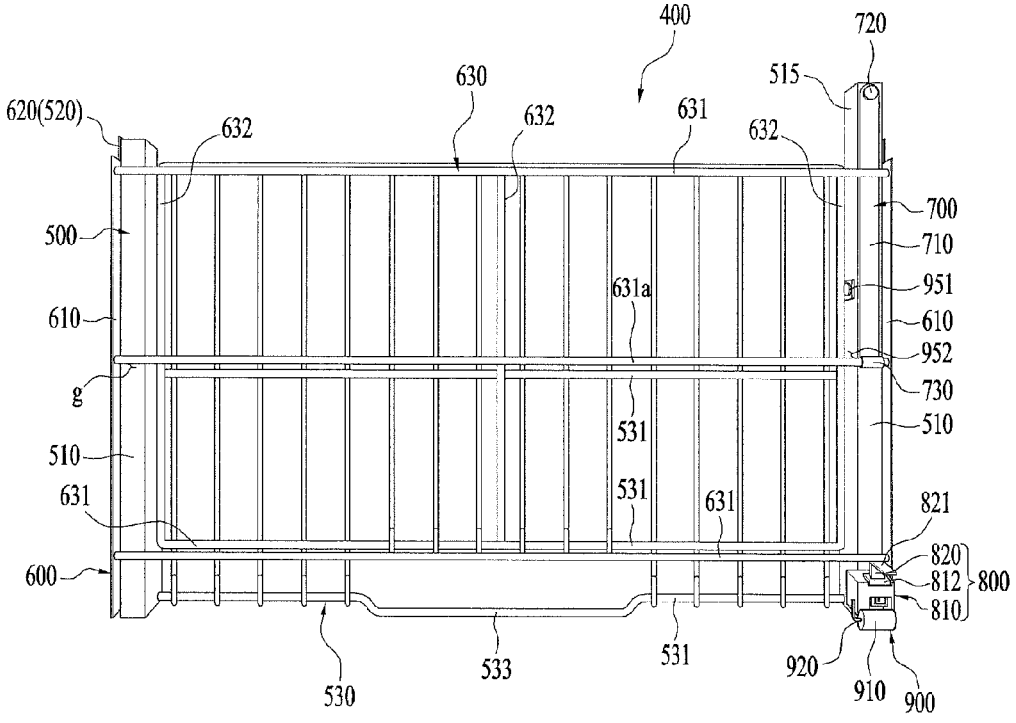
FIG. 8 is a bottom perspective view showing the rack assembly shown in FIG. 5, to which a shock-absorbing member is added.
Figure 9:
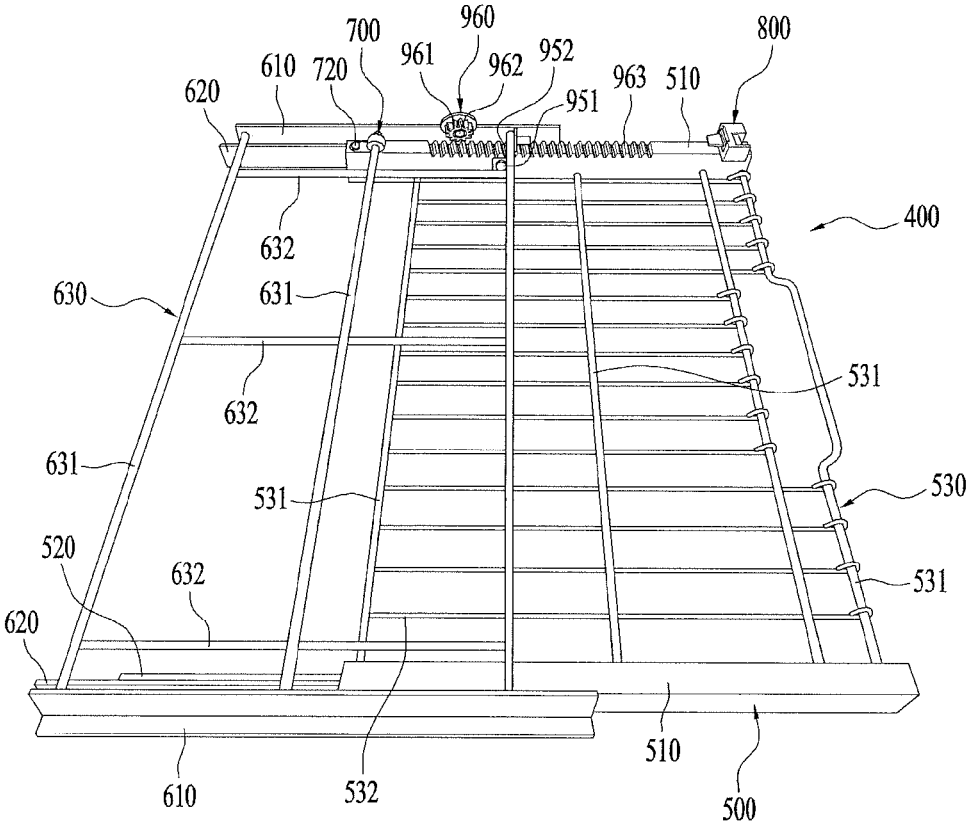
FIG. 9 is a bottom perspective view showing the rack assembly shown in FIG. 5, to which a damper is added.

As exemplarily shown in FIG. 8, one example of the shock-absorbing member 900 may include a roller 910. The roller 910 may be configured to perform rolling, rather than sliding, on the inner surface of the door 300. This may minimize friction and facilitate easy conversion of force.

More specifically, a rotating shaft 920 of the roller 910 may be arranged parallel to the rotating shaft 320 of the door 300. Thus, the roller 910 is rotated when the door 300 is closed. As such, the roller 910 may accomplish minimized friction owing to rolling thereof and may easily convert force applied to close the door 300 into force to push the operating member 500.

The shock-absorbing member 900 may be located at a foremost position of the operating member 500. The shock-absorbing member 900 may also be located at a lowermost position of the operating member 500. For example, as exemplarily shown in FIG. 8, the shock-absorbing member 900 may be mounted to the latch housing 811. This is because the latch housing 811 extends downward from the operating member 500 and, therefore, mounting the shock-absorbing member 900 to the latch housing 811 may achieve a sufficient distance between the operating member 500, more particularly, the operating member bracket 510 and the shock-absorbing member 900.

Through provision of the shock-absorbing member 900, more particularly, the roller 910, the shock-absorbing member 900 may come into contact with the inner surface of the door 300 upon opening and closing of the door 300, which may reduce friction and minimize shock caused upon contact between the door 300 and the operating member 500.

In one embodiment of the present invention, a stopper 950 may be provided. The stopper 950 may function to limit the maximum removal distance of the operating member 500. That is, the stopper 950 may function to prevent additional removal of the operating member 500. Of course, this function may be accomplished by the above-described spring device 700. However, it may be necessary to limit the maximum removal distance of the operating member 500 at a position regardless of a contact position of the first fixing piece 720 and the second fixing piece 730. Accordingly, the stopper 950 may be provided separately from the spring device 700.

The stopper 950 may be located between the operating member 500 and the support member 600 to selectively come into contact with the operating member 500 or the support member 600.

The operating member 500 may be provided with a first protrusion 951. The first protrusion 951 may be formed so as not to interfere with the support member 600 during sliding of the operating member 500. In addition, the support member 600 may be provided with a second protrusion 952. The second protrusion 952 may be formed so as not to come into contact with the other portion of the operating member 500 during sliding of the operating member 500. As the first protrusion 951 is moved during sliding of the operating member 500, the first protrusion 951 and the second protrusion 952 may come into contact with each other in the maximally removed state of the operating member 500. That is, the first protrusion 951 may be caught by the second protrusion 952 so as not to be further moved.

The first protrusion 951 may be formed at the operating member bracket 510, and the second protrusion 952 may be formed at the support member frame 610 of the support member 600. In particular, the second protrusion 952 may be formed at one of the transversal frames 631.

At the maximum removal distance of the operating member 500, the second protrusion 952 of the support member 600 interferes with the first protrusion 951, thereby preventing further movement of the first protrusion 951.

As described above, a vertical gap is defined between the support member 600 and the operating member 500. Thus, the first protrusion 951 and/or the second protrusion 952 may protrude toward each other for reduction in the vertical gap.

FIG. 5 shows the first protrusion 951 as being formed at the operating member bracket 510. In particular, the first protrusion 951 is shown as being formed at an inner surface of the operating member bracket 510. Thus, the operating member bracket 510 may be moved until the first protrusion 951 collides with the second protrusion 952 formed at the support member 600. Here, the first protrusion 951 may be formed at the lower surface of the operating member bracket 510. However, the reason why the first protrusion 951 is formed at the inner surface of the operating member bracket 510 is that the above-described spring device 700 is formed at the lower surface of the operating member bracket 510. Of course, the first protrusion 951 may be formed at each of the operating member brackets 510, or may be formed at only one of the operating member brackets 510.

However, preferably, the stopper 950 and the spring device 700 as described above are formed only at one of the operating member brackets 510. This is because providing all additive components of basic components, i.e. the support member 600 and the operating member 500 at only one operating member bracket 510 may facilitate easy manufacture and installation. That is, these additive components may be easily added to the basic components.

In one embodiment of the present invention, a damper 960 may be provided.

The damper 960 may be configured to come into contact with the operating member 500 and serve to prevent the operating member 500 from being rapidly removed by elastic restoration force of the spring device 700. That is, a greater removal speed of the operating member 500 may cause greater repulsive force applied to the operating member 500 by the damper 960. Based on this principle, the damper 960 may ensure removal of the operating member 500 at an appropriate speed.

Specifically, the damper 960 may include a spur gear 961. A rotating shaft 962 of the spur gear 961 may be arranged perpendicular to a movement direction of the operating member 500. In addition, a rack gear 963 to be engaged with the spur gear 961 may be provided. The rack gear 963 may be installed to the operating member 500. In particular, the rack gear 963 may be installed to the operating member bracket 510.

More specifically, the rack gear 963 may be located at the lower surface of the operating member bracket 510. That is, the rack gear 963 may be located at a front end of the lower surface of the operating member bracket 510. In this case, the above-described spring device 700 may be located at a rear end of the lower surface of the operating member bracket 510. This arrangement may prevent interference between the damper 960 and the spring device 700. In addition, the spur gear 961 may be filled with oil, thereby generating damping force upon rotation thereof. In addition, the spur gear 961 may be secured to the support member bracket 610.

In one embodiment of the present invention, at least one of the coupling device 800, the shock-absorbing member 900, the stopper 950 and the damper 960 as described above may be included.

Meanwhile, in the above-described embodiment, the spring device 700 may be located at one side of the rack assembly 400. That is, the spring device 700 may provide the operating member 500 with movement force or resistance against movement at one side of the operating member 500, rather than both sides of the operating member 500.

All of the coupling device 800, the shock-absorbing member 900, the stopper 950 and the damper 960 as described above may be referred to as means to limit movement of the operating member 500 or to provide resistance against movement of the operating member 500. Of course, all of these components may be referred to as means to which force is directly applied.

The operating member 500 of the rack assembly 400 may slide on the rails installed at both sides thereof. All means to generate force for movement of the operating member 500 and to generate resistance against movement of the operating member 500 are preferably located at the same side as the spring device 700.

As is apparent from the above description, in one embodiment, it is possible to provide an oven which may allow a user to remove or introduce a rack by operating a door rather than the rack. In this way, it is possible to provide an oven which may allow a user to easily remove or introduce a rack without gripping and operating the hot rack.

In one embodiment, it is possible to provide an oven which may allow a rack to be automatically removed even when a user does not apply force to remove the rack.

In one embodiment, it is possible to provide an oven which may allow manual removal and automatic removal of a rack to be selectively performed when a door is opened.

In one embodiment, it is possible to provide an oven which may allow a user to introduce a rack without gripping the rack.

In one embodiment, it is possible to provide an oven which may allow a user to remove a rack by operating the rack for a short time in an open state of a door.

In one embodiment, it is possible to provide an oven which includes a spring device to enable automatic removal of a rack, the spring device being installed so as not to come into contact with a cooking object and hidden so as not to be viewed by a user, thus having enhanced reliability.

In one embodiment, it is possible to provide an oven which may achieve the above-described effects without considerable changes in conventional rack structures.

In one embodiment, it is possible to provide an oven which may allow automatic removal or semi-automatic removal of a rack to be selectively performed when a door is opened.

In one embodiment, it is possible to provide an oven which may prevent rapid removal of a rack.

In one embodiment, it is possible to provide an oven which includes a variety of components to enable automatic removal or semi-automatic removal of a rack, these components being arranged at positions not to be viewed by a user, thereby achieving enhanced reliability and convenience in use. In addition, it is possible to provide an oven which may prevent these components from being contaminated by a cooking object.

Although the exemplary embodiments have been illustrated and described as above, of course, it will be apparent to those skilled in the art that the present invention is not limited to the above described particular embodiments, and various modifications and variations can be made in the present invention without departing from the spirit or scope of the present invention, and the modifications and variations should not be understood individually from the viewpoint or scope of the present invention.

What is claimed is:

1. An oven comprising:

a cabinet having a chamber configured to receive a cooking object in the chamber;

a door configured to open and close the cabinet;

a rack assembly that includes:

an operating member that is configured to support the cooking object and that is configured to be removable outward from an interior of the chamber, and a support member fixed inside the chamber and configured to support the operating member; and a spring device including a first fixing piece located at the operating member, a second fixing piece located at the support member, and an elastic member having a first side connected to the first fixing piece and a second side connected to the second fixing piece, the elastic member being located in a vertical gap between the operating member and the support member and being configured to remove the operating member from the chamber based on being elastically restored by an increased distance between the first fixing piece and the second fixing piece, wherein the elastic member includes a leaf-spring configured to be elastically deformed such that a number of windings of the leaf-spring around the first fixing piece or the second fixing piece is reduced as a distance between the first fixing piece and the second fixing piece increases.

2. The oven according to claim 1, further comprising a coupling device configured to selectively couple the support member and the operating member to each other so as to selectively cause movement of the operating member relative to the support member.

3. The oven according to claim 2, wherein the coupling device includes a latch assembly and a latch striker configured to be selectively coupled to the latch assembly.

4. The oven according to claim 3, wherein the latch assembly is located at one of the operating member or the support member, and the latch striker is located at another of the support member or the operating member so as to face the latch assembly.

5. The oven according to claim 2, wherein the operating member is configured to come into contact with an inner surface of the door in a closed state of the door and to remain coupled to the support member by the coupling device.

6. The oven according to claim 5, wherein the coupling between the operating member and the support member by the coupling device is configured to be released as the operating member is further moved into the interior of the chamber in a coupling direction of the coupling device.

7. The oven according to claim 2, wherein the spring device is arranged at one side or both sides of the rack assembly.

8. The oven according to claim 2, wherein the coupling device is arranged at one side or both sides of the rack assembly.

9. The oven according to claim 2, wherein the spring device is arranged at one side of the rack assembly, and the coupling device is arranged at the same side of the rack assembly as the spring device.

10. The oven according to claim 1, wherein the operating member is wholly received in the chamber based on the elastic member being elastically deformed, and the operating member is at least partially removed from the chamber based on the elastic member being elastically restored.

11. The oven according to claim 1, further comprising a damper configured to come into contact with the operating member to restrict removal of the operating member.

12. The oven according to claim 1, wherein the door is a pull-down type door to allow a user to grip a door handle and open the door downward.

13. The oven according to claim 1, wherein the operating member further comprises a shock-absorbing member configured to come into contact with an inner surface of the door based on the door being closed while the operating member is at least partially removed from the chamber, the shock-absorbing member configured to convert a closing force of the door into a force that introduces the operating member into the chamber.

14. The oven according to claim 13, wherein the shock-absorbing member includes a roller configured to be rotated about a rotating shaft parallel to a rotating shaft of the door.

15. The oven according to claim 1, further comprising a stopper located between the operating member and the support member to selectively come into contact with one of the operating member or the support member, thereby limiting a distance by which the operating member is removable from the chamber.

16. The oven according to claim 1, wherein:

the support member includes support member brackets fixed at both sides of the chamber, a support member rail installed to an inner surface of each of the support member brackets, and a support member frame connecting both the support member brackets to each other; and the operating member includes operating member brackets fixed at both sides of the chamber, an operating member rail installed to an outer surface of each of the operating member brackets, the operating member rail being connected to the support member rail, and an operating member frame connecting both the operating member brackets to each other.

17. The oven according to claim 16, wherein the operating member frame is spaced above the support member frame by a prescribed distance.

18. The oven according to claim 17, wherein the operating member is configured to be removed from the chamber by sliding relative to the support member as the operating member rail moves relative to the support member rail upon elastic restoration of the elastic member.

19. An oven comprising:

a cabinet having a chamber configured to receive a cooking object in the chamber;

a door configured to open and close the cabinet;

a rack assembly that includes an operating member that is configured to support the cooking object and that is configured to be removable outward from an interior of the chamber, and a support member fixed inside the chamber and configured to support the operating member; and a spring device including a first fixing piece located at an operating member bracket of the operating member, a second fixing piece located at a support member frame of the support member, and an elastic member having a first side connected to the first fixing piece and a second side connected to the second fixing piece, the elastic member being configured to remove the operating member from the chamber based on being elastically restored by an increased distance between the first fixing piece and the second fixing piece, wherein the elastic member includes a leaf-spring configured to be elastically deformed such that a number of windings of the leaf-spring around the first fixing piece or the second fixing piece is reduced as a distance between the first fixing piece and the second fixing piece increases.

20. The oven according to claim 19, wherein:

the support member frame of the support member extends from one side of the chamber to an opposite side of the chamber; and the operating member includes an operating member frame extending from the one side of the chamber to the opposite side of the chamber and is configured to support the cooking object, the operating member frame being spaced above the support member frame by a prescribed distance.

21. The oven according to claim 20, wherein the support member includes support member brackets fixed at both sides of the chamber and a support member rail installed to an inner surface of each of the support member brackets; and the operating member includes operating member brackets fixed at both sides of the chamber, one of the operating member brackets being the operating member bracket at which the first fixing piece is located, and an operating member rail installed to an outer surface of each of the operating member brackets, the operating member rail being connected to the support member rail.

22. The oven according to claim 21, wherein each of the support member frame and the operating member frame includes a plurality of transversal frames extending in a side-to-side direction and a plurality of longitudinal frames extending in a front-and-rear direction.

23. The oven according to claim 22, wherein the spring device is located in a vertical gap between the bottom of the operating member bracket at which the first fixing piece is located and a corresponding one of the transversal frames of the support member frame.

24. The oven according to claim 23, wherein:

the first fixing piece is located at the bottom of the operating member bracket at which the first fixing piece is located; and the second fixing piece is located at the corresponding transversal frame of the support member frame.

25. The oven according to claim 24, wherein the elastic member extends from the first fixing piece to the second fixing piece along a lower surface of the operating member bracket at which the first fixing piece is located.

26. The oven according to claim 24, wherein the first fixing piece protrudes downward from the operating member bracket at which the first fixing piece is located by a prescribed distance so as to be caught by the second fixing piece, thereby limiting a distance by which the operating member is removable from the chamber.

27. The oven according to claim 24, wherein the one of the operating member brackets that is provided with the first fixing piece has a rearwardly protruding extension that is different from the other operating member bracket and is configured to provide an increased distance between the first fixing piece and the second fixing piece, the first fixing piece being located at and end of the extension.

28. The oven according to claim 21, wherein:

the transversal frames of the support member frame and the operating member frame are connected to the support member brackets and the operating member brackets, respectively; and a number of the longitudinal frames of the operating member frame is greater than a number of the longitudinal frames of the support member frame.

29. The oven according to claim 28, wherein the longitudinal frames of the operating member frame have a front-and-rear length that is greater than a front-and-rear length of the longitudinal frames of the support member frame.

30. The oven according to claim 28, wherein the transversal frame located at a foremost position of the operating member frame includes a forwardly protruding portion.

* * * * *